US006228193B1

(12) United States Patent
Blomquist

(10) Patent No.: US 6,228,193 B1
(45) Date of Patent: May 8, 2001

(54) VEHICLE OCCUPANT PROTECTION DEVICE AND SOLID SOLUTION GAS GENERATING COMPOSITION THEREFOR

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/052,413

(22) Filed: Mar. 31, 1998

(51) Int. Cl.[7] ..... C06B 45/10; C06B 31/00; C06B 31/28

(52) U.S. Cl. ..... 149/19.91; 149/45; 149/46

(58) Field of Search ..... 149/45, 46, 19.1, 149/19.91; 280/736, 737

(56) References Cited

U.S. PATENT DOCUMENTS

| | | | | |
|---|---|---|---|---|
| 3,419,443 | | 12/1968 | Maes | 149/1 |
| 3,821,043 | | 6/1974 | Sippel | 149/36 |
| 4,527,389 | * | 7/1985 | Biddle et al. | 60/207 |
| 5,060,973 | | 10/1991 | Giovanetti | 280/736 |
| 5,223,057 | | 6/1993 | Mueller et al. | 149/45 |
| 5,386,777 | | 2/1995 | Lou et al. | 102/291 |
| 5,451,277 | | 9/1995 | Katzakian et al. | 149/19.92 |
| 5,607,181 | | 3/1997 | Richardson et al. | 280/737 |
| 5,683,104 | | 11/1997 | Smith | 280/736 |
| 5,684,269 | | 11/1997 | Barnes et al. | 149/45 |
| 5,703,323 | | 12/1997 | Rothgery et al. | 149/88 |
| 5,734,124 | * | 3/1998 | Bruenner et al. | 149/36 |
| 5,837,931 | * | 11/1998 | Bruenner et al. | 149/109.6 |
| 5,847,315 | * | 12/1998 | Katzakian, Jr. et al. | 149/19.91 |

FOREIGN PATENT DOCUMENTS 969708 9/1964 (GB) .

OTHER PUBLICATIONS

Report "Environmentally Aware Rocket Propellants—Solid Rocket Propellants for Future Applications, i.e., Designer Propellants", Art Katzakian, Solid Rocket Technical Committee Lecture Series, Jan. 10–12, 1994.

* cited by examiner

*Primary Examiner*—Charles T. Jordan
*Assistant Examiner*—Aileen J. Baker
(74) *Attorney, Agent, or Firm*—Tarolli, Sundheim, Covell, Tummino & Szabo L.L.P.

(57) ABSTRACT

A vehicle occupant protection device comprises a body of gas generating material which comprises a solid solution of a water soluble liquid oxidizer and a hydrophilic polymeric gelling agent. The gelling agent comprises carbon atoms in an effective amount to function as a fuel with the liquid oxidizer. The solid solution also comprises water, preferably in the amount of about 5% to about 25% based on the weight of the body of gas generating material. The water reduces the temperature of the gas which is produced and also increases its volume, making the gas generating material suitable for a vehicle occupant protection device. A preferred oxidizer is hydroxyl ammonium nitrate or derivative thereof. A preferred gelling agent is polyvinyl alcohol.

17 Claims, 1 Drawing Sheet

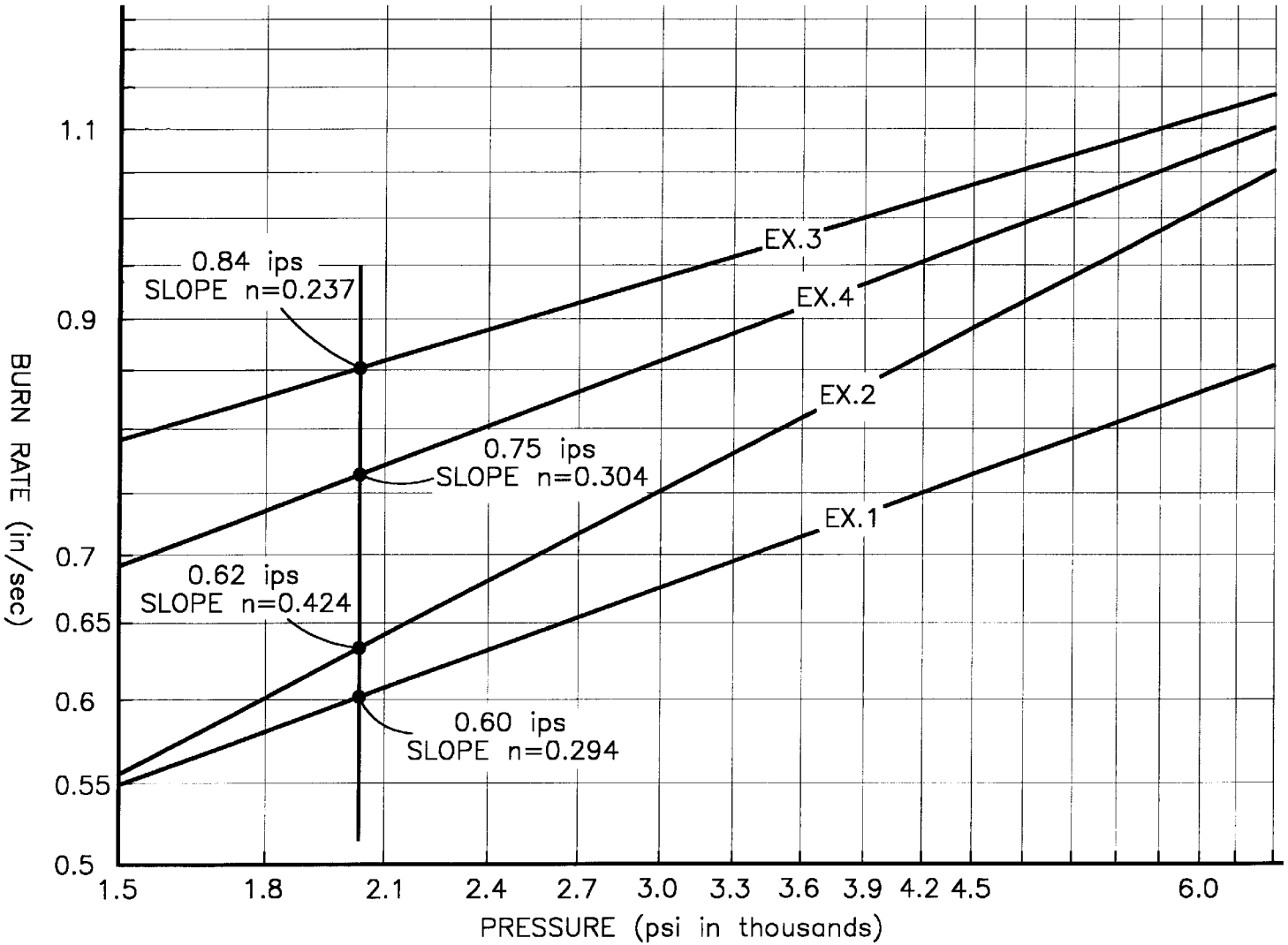
Figure

VEHICLE OCCUPANT PROTECTION DEVICE AND SOLID SOLUTION GAS GENERATING COMPOSITION THEREFOR

BACKGROUND OF THE INVENTION

1. Technical Field

The present invention relates to a vehicle occupant protection device, and particularly to a gas generating material which is useful in the protection device.

2. Description of the Prior Art

An inflator for inflating a vehicle occupant protection device, such as an air bag, contains a body of ignitable gas generating material. The inflator further includes an igniter. The igniter is actuated so as to ignite the body of gas generating material when the vehicle experiences a condition, such as a sudden deceleration, which is indicative of a collision for which inflation of the air bag is desired. As the body of gas generating material burns, it generates a volume of inflation gas. The inflation gas is directed into the vehicle air bag to inflate the air bag. When the air bag is inflated, it expands into the vehicle occupant compartment and helps to protect the vehicle occupant.

U.S. Pat. No. 5,060,973 discloses a vehicle occupant restraint apparatus which comprises a liquid gas generating composition. The composition comprises 60% hydroxyl ammonium nitrate (HAN) as an oxidizer, 20% triethanol ammonium nitrate (TEAN) as a fuel, and 20% water. The HAN and TEAN are water soluble.

U.S. Pat. No. 5,223,057 discloses a liquid monopropellant suitable for underwater and surface propulsion of ordnance vehicles. The composition comprises a solution or emulsion of hydroxyl ammonium nitrate (HAN), a water soluble or water dispersible fuel, and water. A number of fuels are listed such as alcohols, glycols, and amines. The amount of water is about 5% to 100% of the combined weight of fuel and oxidant, and functions as a desensitizing agent for the HAN and serves to provide cooling to control the flame temperature of the combustion reaction.

U.S. Pat. No. 5,451,277 discloses a method for preparing solid energetic compositions using liquid oxidizers. Hydroxyl ammonium nitrate (HAN) is listed as a suitable liquid oxidizer. Solid fuel particles such as a metal fuel are coated with a polyvinyl alcohol coating. The polymer-coated particles are dried and then combined with the liquid oxidizer forming a dispersion. The dispersion is cast into a mold. The liquid oxidizer is absorbed by the polymer coating causing aggregation of the dispersion into a rubbery solid mass.

U.S. Pat. No. 5,684,269 discloses a liquid gas generating composition suitable for automotive restraint systems. The composition comprises HAN and a nitrate salt of an amine such as an amino tetrazole.

SUMMARY OF THE INVENTION

The present invention resides in a vehicle occupant protection device which comprises a body of gas generating material. The body of gas generating material comprises a solid solution of (i) a water soluble liquid oxidizer, (ii) a hydrophilic polymeric gelling agent, wherein said gelling agent comprises carbon atoms in an effective amount to function as a fuel with said liquid oxidizer, and (iii) water.

The water reduces the temperature of the gas which is produced and also increases the volume of gas, making the gas generating material of the present invention suitable for a vehicle occupant protection device.

In a preferred embodiment of the present invention, the liquid oxidizer is hydroxyl ammonium nitrate and the hydrophilic polymeric gelling agent is polyvinyl alcohol.

Preferably, the body of gas generating material comprises about 50% to about 90% hydroxyl ammonium nitrate (dry weight), about 5% to about 25% polyvinyl alcohol and about 5–25% water based on the weight of said body of gas generating material.

A preferred polyvinyl alcohol is one having an average molecular weight in the range of about 13,000 to 186,000.

Preferably, the ratio of polyvinyl alcohol to hydroxyl ammonium nitrate is that ratio which is effective for combustion of carbon in the polyvinyl alcohol to carbon dioxide.

BRIEF DESCRIPTION OF THE DRAWING

The invention and advantages thereof will become more apparent from the following description with reference to the accompanying drawing in which the FIGURE is a chart plotting burn rate against pressure for the combustion of samples of gas generating material prepared in accordance with the present invention.

DESCRIPTION OF PREFERRED EMBODIMENTS OF THE INVENTION

The body of gas generating material of the present invention is primarily for vehicle occupant protection devices such as air bags, inflatable seat belts, inflatable knee bolsters, knee bolsters operated by inflatable air bags, inflatable head liners and inflatable side curtains. The vehicle occupant protection device comprises an inflator which contains the body of gas generating material. The inflator comprises an igniter which is actuated when the vehicle experiences a condition, such as sudden deceleration, which is indicative of a collision for which inflation of the air bag is desired. The igniter ignites the body of gas generating material. As the body of gas generating material burns, it generates a volume of inflation gas. This inflation gas is directed into the air bag to inflate the air bag. When the air bag is inflated, it expands into the vehicle occupant compartment and helps to protect the vehicle occupant.

The body of gas generating material of the present invention comprises a water soluble liquid oxidizer, a water soluble gelling agent which has carbon atoms in an effective amount to function as a fuel with the liquid oxidizer, and water in the amount of about 5% to about 25% based on the weight of the body of gas generating material. The amount of water soluble gelling agent is that amount which is effective to form a solid solution of the liquid oxidizer wherein the solid solution has good mechanical properties. By "good mechanical properties", it is meant having good elasticity and good tensile strength over a wide temperature range, for the projected life of the inflator.

A preferred water soluble liquid oxidizer is hydroxyl ammonium nitrate. The hydroxyl ammonium nitrate is a water soluble salt which is represented by the formula:

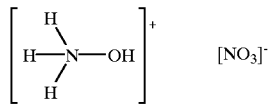

The hydroxyl ammonium nitrate has a molecular weight of 96 and is commercially available as a clear viscous solution comprising 15 to 25 weight percent water and 75 to 85 weight percent hydroxyl ammonium nitrate. A preferred hydroxyl ammonium nitrate for use in the present invention comprises about 18 to 24 weight percent water. With this concentration of water, the hydroxyl ammonium nitrate is stable, and has a high decomposition temperature, for instance above about 148° C.

Examples of other liquid water soluble oxidizers, known to those skilled in the art, that can be used in the practice of the present invention include lower alkyl derivatives of hydroxyl ammonium nitrate such as N-methyl, N-ethyl, O-methyl, O-ethyl, hydrazinium nitrate, and dihydroxyethylammonium nitrate.

The amount of oxidizing agent in the gas generating composition is an effective amount to form, with the gelling agent, a combustible mixture, preferably an amount effective to oxidize the carbon atoms in the gelling agent predominantly to carbon dioxide. A preferred amount is within the range of about 50 to about 90 weight percent (dry weight) based on the weight of the gas generating material.

The gelling agent in the body of gas generating material is one which, when employed in a gelling amount, has sufficient carbon atoms to function as a fuel and produce, with the liquid oxidizer, a combustible mixture. A preferred gelling agent is polyvinyl alcohol. Polyvinyl alcohol can be represented by the following formula:

$$(\text{—}CH_2CHOH\text{—})_n$$

Polyvinyl alcohol is a water soluble synthetic polymer made by the alcoholysis of polyvinyl acetate. It is commercially available as a white or cream powder in a range of average molecular weights, from a low molecular weight, low viscosity grade (below 35,000 molecular weight) to a super high molecular weight, super high viscosity grade (250,000 to 300,000 molecular weight). A preferred molecular weight in the present invention is within the range between a low viscosity grade which is 87% to 89% hydrolyzed and having an average molecular weight of about 13,000 to 23,000, to a mid-viscosity grade which is 99+% hydrolyzed and having an average molecular weight of about 124,000 to 186,000.

The amount of polyvinyl alcohol used is an effective amount to produce a gel structure having good mechanical strength. The inflator must function properly over a wide temperature range, for instance from a low of about −40° C. to a high of about 95° C. This means that the body of gas generating material must be neither brittle at −40° C. nor capable of losing its shape or configuration at 95° C. A preferred amount of polyvinyl alcohol to achieve these properties is in the range of about 5% to about 25% based on the weight of the body of gas generating material.

Other hydrophilic gelling agents containing substantial carbon atoms and having high temperature thermal stability so as to be useful as fuels include hydroxyl ethyl acrylates, cellulose derivatives such as carboxymethylcellulose and hydroxylpropylcellulose, polymers derived from vinyl esters such as polyvinylpyrolidone or polyvinyl amides, starches such as carboxymethyl starch, alginates, casein, gums, lattices such as styrene-butadiene latex, and mixtures of the same, including mixtures with polyvinyl alcohol.

A critical component of the body of gas generating material of the present invention is water, preferably in the range of about 5% to about 25% based on the weight of the body of gas generating material. At least 5% water is desirable to cool the products of combustion of the oxidizer and fuel for use in a vehicle occupant restraint, preferably to cool the products of combustion to a temperature less than about 2500° Kelvin, preferably in the range of about 1800° to 2500° Kelvin. By cooling the products of combustion, the vehicle occupant restraint can be made of components which are lighter in weight and of less expensive materials.

At more than 25% water, the burning rate of the gas generating material can be adversely affected.

The body of gas generating material of the present invention, or solid solution, consists essentially of a liquid oxidizer, a gelling agent, and water bound into the gelled structure. However, other ingredients can be incorporated into the body in small amounts.

For instance, the body of gas generating material can include up to about 5 weight percent, based on the weight of the body of gas generating material, of ammonium nitrate. The ammonium nitrate enhances the burn rate of the gas generating composition, reducing the amount of hydroxyl ammonium nitrate required. The ammonium nitrate also forms an eutectic with the hydroxyl ammonium nitrate which tends to improve mechanical properties of the body of gas generating material, for instance low temperature properties, resisting embrittlement. Derivatives of ammonium nitrate can also be used.

The body of gas generating material can also comprise small amounts of a stabilizer such as a pyridine or pyridone salt or acid thereof, as disclosed in U.S. Pat. No. 5,703,323. An example of one such stabilizer is 2-hydroxypyridine-N-oxide sodium salt. The abbreviation for this salt is NaHPNO. The stabilizer is primarily a sequestrant for iron. Other suitable sequestrants that can be used are DEQUEST phosphonates marketed by Monsanto Company such as "Dequest 2054" [hexamethylenediamine tetra(methylenephosphonic acid)potassium salt] and "Dequest 2041" [alkylenediamine tetra(methylenephosphonic acid)].

The body of gas generating material can also comprise a burn rate catalyst such as a borohydride, chromium, copper, guanidinium chloride (GNX), hydroxylamine chloride (HAX), and nitroaminotetrazole. Encapsulation of the catalyst may be desirable to avoid decomposition or premature aging of the hydroxyl ammonium nitrate. However, the presence of metal particles to which the hydroxyl ammonium nitrate may be particularly sensitive, such as metal fuel particles, e.g., particles of aluminum, is not preferred as such particles can cause the composition to give, on combustion, too high an impetus value. The impetus value is expressed as joules per gram, and is an indication of the amount of energy produced in the combustion reaction. Preferably, the components of the gas generating composition of the present invention give an impetus value, at a water content of 10 percent, less than about 1200 joules per gram. Too high an impetus value can result in too energetic an expansion of an air bag.

Preparation of bodies of gas generating material of the present invention is achieved by mixing the fuel, oxidizer, water and any other ingredient, heating the mixture to a slightly elevated temperature, casting the heated mixture into a sacrificial mold where the mixture is allowed to cure and then allowing the mixture to cool. Following cooling, the sacrificial mold is removed from the gelled product permitting the gelled product to be cut into lengths providing individual grains suitable for use in a vehicle occupant protection device.

The following Examples illustrate the present invention.

EXAMPLES 1–4

The following formulations (amounts in weight percents) were compared.

| Ingredient | EX 1 | EX 2 | EX 3 | EX 4 |
|---|---|---|---|---|
| Hydroxyl Ammonium Nitrate (dry weight) | 63.64 | 59.66 | 56.23 | 61.26 |
| Water | 14.75 | 18.73 | 18 | 14.2 |
| Polyvinyl Alcohol | 19.4 | 19.4 | 19.6 | 18.67 |
| Ammonium Nitrate | 0.97 | 0.97 | 4.93 | 4.67 |
| Stabilizer ("Dequest" 2054) | 0.8 | 0.8 | 0.8 | 0.77 |
| Stabilizer ("Dequest" 2041) | 0.24 | 0.24 | 0.24 | 0.24 |
| NaHPNO (stabilizer) | 0.2 | 0.2 | 0.2 | 0.19 |

The hydroxyl ammonium nitrate was marketed by Olin Corporation, as a water solution containing 18 weight percent water. The polyvinyl alcohol which was used had a molecular weight of 89,000–98,000. Each of the formulations was made into bodies of gas generating material. This was accomplished by adding the hydroxyl ammonium nitrate to a mixing vessel, and then adding the polyvinyl alcohol, ammonium nitrate, and other components to the hydroxyl ammonium nitrate, and mixing the same. Following mixing, the mixture was cast into casting tubes and cured in a curing oven at 65° C. for 48 hours. The mixture was allowed to air cool for two hours, followed by cooling at −48° C. for six hours. The casting tubes were sacrificial and were removed from the cast mixture. The cast mixture was then cut into lengths providing bodies of gas generating material in the form of cylindrical grains similar to an aspirin tablet. The bodies of gas generating material were in a solid state and had good mechanical properties.

The bodies of gas generating material were tested in a standard closed bomb test apparatus having a capacity of 67 ml. to obtain burn rate information. The testing was conducted in accordance with Mil. Std. Procedure 286C, Method 801.1.2. The weight of each charge tested was 17 grams.

The bodies of gas generating material were also tested in a ballistic test motor having a combustion chamber and a 60 liter tank connected to the combustion chamber through a 4×3.3 mm orifice. The weight of each charge tested in the ballistic test motor was 12 grams. Each charge comprised a plurality of grains, each having a height of 2 mm and a diameter of 12.7 mm. An ignition enhancer in the form of one gram of $BKNO_3$ was distributed half at the igniter face and half throughout the charge bed.

The closed bomb conditions were measured and calculated and are included in the FIGURE and in the following Table 1. Table 1 also contains calculated ballistic test motor combustion chamber conditions, and measured properties.

TABLE 1

| Example | EX 1 | EX 2 | EX 3 | EX 4 |
|---|---|---|---|---|
| Closed Bomb Conditions (Calculated) | | | | |
| Chamber Pressure (psi) | 7,000 | 7,000 | 7,000 | 7,000 |
| Flame Temperature (° K.) | 1,961 | 1,768 | 1,727 | 1,973 |
| CP/CV | 1.217 | 1.223 | 1.225 | 1.215 |
| Gas Moles/100 grams | 4.7 | 4.8 | 4.81 | 4.89 |
| Impetus (joules/gram) | 932 | 863 | 847 | 975 |
| Closed Bomb (measured) | | | | |
| DSC exo onset, C. | 168 | 171 | 169 | 157 |
| DSC exo peak, C. | 175 | 177 | 176 | 162 |
| Burn Rate, 2000 psi | 0.6 | 0.62 | 0.84 | 0.75 |

TABLE 1-continued

| Example | EX 1 | EX 2 | EX 3 | EX 4 |
|---|---|---|---|---|
| Pres. Exp. of Burn rate, slope (n) | 0.294 | 0.424 | 0.237 | 0.304 |
| Ballistic Test Motor Conditions | | | | |
| Inflator Pressure Max. (psi) | 6590 | 6617 | 7234 | 7279 |
| Time to first gas, ms | 5.4 | 6.2 | 4.2 | 4.4 |
| Tank slope psi/ms | 0.886 | 1.039 | 1.319 | 1.279 |
| Tank Pres. Max. (psi) | 25.4 | 33.6 | 28.7 | 36.1 |
| Sensitivity Properties | | | | |
| Friction Sensitivity (50% point (kilopond)) | 9.53 | 10.8 | 13.28 | 8.9 |
| Impact Sensitivity (2 kG weight at 80 cm) | Negative | Negative | Negative | Negative |
| Electrostatic Sensitivity (18.38 Joules) | Negative | Negative | Negative | Negative |

Examples 2 and 3, compared to Examples 1 and 4, show, in the closed bomb calculated data, that the flame temperature was reduced by 200° Kelvin or more with increased water. This was accomplished without significant change in the CP/CV ratio or moles of gas produced. The CP/CV ratio is the ratio of specific heat at specific pressure (CP) to specific heat at specific volume (CV). This ratio is an indication of the expansion of a gas with a change in temperature. A slight reduction in energy output (impetus) occurred. The amount of gas produced in all of the Examples, 4.7 to 4.89 moles, was very good, and was partly due to the water present in the gas generating composition.

In the closed bomb measured data, Examples 3 and 4 show that with about 5% added ammonium nitrate, the burn rate was significantly increased. However, the burn rates for all of the Examples (0.6 to 0.84) were very good.

All of the Examples had relatively low burn rate slopes (n), as shown in Table 1 and in the FIGURE. A relatively low burn rate slope is advantageous for a vehicle occupant protection device permitting the use of more conventional materials and thinner walled vessels for the inflator apparatus. The best combinations of burn rates and burn rate slopes (n) were achieved with the compositions of Examples 3 and 4 which contained about 5% added ammonium nitrate.

The measurements in the ballistic motor tests were also very good, mirroring to a degree the results of the closed bomb tests.

The measured data of Table 1 also shows that the friction sensitivity was better in Examples 2 and 3, with increased water content, compared to Examples 1 and 4. However, all of the friction sensitivity measurements are good. The bodies of gas generating material were also relatively insensitive to impact or an electrostatic discharge in the impact and electrostatic sensitivity tests to which they were exposed.

All of the Examples produced a gas product containing low amounts of carbon monoxide and nitrogen oxides.

The bodies of gas generating material had good mechanical properties throughout a temperature range from −40° C. to 95° C. including good aging properties from high temperatures cycling and lack of brittleness from low temperature cycling.

EXAMPLES 5–10

These Examples illustrate the effect of water content on combustion temperature. All temperatures were calculated at a combustion pressure of 2,000 psi.

| Example | 5 | 6 | 7 | 8 | 9 | 10 |
|---|---|---|---|---|---|---|
| HAN | 71.5 | 69.9 | 68.2 | 66.5 | 64.8 | 63.1 |
| PVA | 13.7 | 13.3 | 13 | 12.7 | 12.4 | 12.1 |
| $H_2O$ | 9.8 | 11.8 | 13.8 | 15.8 | 17.8 | 19.8 |
| AN | 5 | 5 | 5 | 5 | 5 | 5 |
| TEMP ° F. | 3994 | 3874 | 3751 | 3626 | 3497 | 3367 |
| TEMP ° K. | 2474 | 2408 | 2339 | 2269 | 2198 | 2126 |

Advantages of the present invention should be apparent. The gas generating material is particularly suitable for a vehicle occupant protection device. The material produces a gas product which is non-toxic and free of particulates. The present invention offers a means for providing a relatively cool gas while at the same time increasing the volume of gas which is produced. The bodies of gas generating material which are used have good burn rate characteristics, good mechanical properties over a wide temperature range, and resist aging. In this respect, it should be noted that the bodies of gas generating material are essentially free of metal particulate, for instance aluminum or iron, to which hydroxyl ammonium nitrate is particularly sensitive. In addition to improving aging, this provides a combustion reaction having a lower impetus value suitable for a vehicle occupant protection device.

From the above description of the invention, those skilled in the art will perceive improvements, changes and modifications. Such improvements, changes and modifications within the skill of the art are intended to be covered by the appended claims.

Having described the invention, the following is claimed:

1. A vehicle occupant protection device comprising a body of gas generating material, said body consisting essentially of:

(a) a solid solution of (i) a water soluble liquid oxidizer;

(ii) a hydrophilic polymeric gelling agent wherein said gelling agent comprises an effective amount of carbon atoms to provide a combustible mixture with said liquid oxidizer in said body of gas generating material;

(iii) zero to about 5% ammonium nitrate; and (iv) about 5% to about 25% water;

the amounts of (i) through (iv) being based on the weight of gas generating material.

2. The device of claim 1 wherein said oxidizer and gelling agent are present in the amounts of about 50% to about 90% and about 5% to about 25%, respectively, based on the weight of gas generating material.

3. The device of claim 2 wherein said liquid oxidizer is hydroxyl ammonium nitrate or a derivative thereof, and said gelling agent is polyvinyl alcohol.

4. The device of claim 3 wherein said polyvinyl alcohol has an average molecular weight in the range of about 13,000 to about 186,000.

5. The device of claim 4 wherein the ratio of polyvinyl alcohol to hydroxyl ammonium nitrate is that necessary for oxidation of carbon to carbon dioxide.

6. The device of claim 5 wherein the water content is an effective amount to obtain a combustion temperature less than about 2500° Kelvin.

7. The device of claim 6 wherein the components of the body of gas generating material, at a water content of 10%, give an impetus value less than about 1100 joules per gram.

8. A vehicle occupant protection device comprising a body of gas generating material, said body of gas generating material comprising a solid solution of:

(i) a water soluble liquid oxidizer;

(ii) a hydrophilic polymeric gelling agent wherein said gelling agent comprises an effective amount of carbon atoms to provide a combustible mixture with said liquid oxidizer in said body of gas generating material; and (iii) about 5% to about 25% water based on the weight of the gas generating material;

wherein the body of gas generating material has a burn rate less than about 1 inch/sec at 2,000 psi.

9. A vehicle occupant protection device comprising a body of gas generating material, said body of gas generating material comprising a solid solution of:

(i) hydroxyl ammonium nitrate or a derivative thereof;

(ii) polyvinyl alcohol; and (iii) about 5% to about 25% water based on the weight of the gas generating material.

10. The device of claim 9 wherein said polyvinyl alcohol has an average molecular weight in the range of about 13,000 to about 186,000.

11. The device of claim 10 wherein the ratio of polyvinyl alcohol to hydroxyl ammonium nitrate is that ratio effective for oxidation of carbon in the gas generating material to carbon dioxide.

12. A vehicle occupant protection device comprising a body of gas generating material, said body of gas generating material comprising, on a weight basis, a solid solution of:

(i) about 50% to about 90% hydroxyl ammonium nitrate;

(ii) about 5% to about 25% polyvinyl alcohol; and (iii) about 5% to about 25% water.

13. The device of claim 12, wherein the body of gas generating material comprises up to about 5% ammonium nitrate, based on the weight of the gas generating material.

14. A vehicle occupant protection device comprising a body of gas generating material, said body of gas generating material comprising, on a weight basis, a solid solution of:

(i) about 50% to about 90% hydroxyl ammonium nitrate;

(ii) about 5% to about 25% polyvinyl alcohol;

(iii) about 5% to about 25% water; and (iv) zero to about 5% ammonium nitrate.

15. A vehicle occupant protection device comprising a body of gas generating material, said body of gas generating material consisting essentially of, on a weight basis, a solid solution of:

(i) about 50% to about 90% hydroxyl ammonium nitrate;

(ii) about 5% to about 25% polyvinyl alcohol;

(iii) about 5% to about 25% water; and (iv) zero to about 5% ammonium nitrate.

16. The device of claim 8 wherein said body of gas generating material is essentially free of metal particulate.

17. The device of claim 16 wherein the components of the body of gas generating material, at a water content of 10%, give an impetus value less than about 1100 joules per gram.

* * * * *